United States Patent [19]

Coskery

[11] Patent Number: 5,046,636

[45] Date of Patent: Sep. 10, 1991

[54] REFUSE RECYCLING BOX

[75] Inventor: Stephen Coskery, Mississauga, Canada

[73] Assignee: Busch-Coskery of Canada Inc., Barrie, Canada

[21] Appl. No.: 413,616

[22] Filed: Sep. 28, 1989

[51] Int. Cl.[5] ..... A65D 8/00

[52] U.S. Cl. ..... 220/571; 220/555; 220/908; 220/94 A

[58] Field of Search ..... 220/74, 94 A, 94 R, 220/1 T, 571, 572, 555, 908, 909

[56] References Cited

U.S. PATENT DOCUMENTS

| | | | |
|---|---|---|---|
| 3,902,599 | 9/1975 | Stromberg | 220/74 |
| 4,042,142 | 8/1977 | Ruano | 220/94 R |
| 4,787,527 | 11/1988 | Monetti | 220/74 |

*Primary Examiner*—Joseph Man-Fu Moy
*Attorney, Agent, or Firm*—Mirek A. Waraksa

[57] ABSTRACT

A unitary injection-molded plastic refuse collection box is adapted to reduce back strain during lifting. The box has a bottom and a generally rectangular side wall. A handle extends circumferentially about the side wall external to the compartment. The handle has a uniform inverted L-shaped cross-section, the cross-sectional dimensions of the handle being sufficient to permit a person to insert his fingers between the handle and the associated side wall to the second joints of his fingers. The upper handle portion has a lowermost terminating portion defining an expanded, downwardly-facing convex surface which comfortably engages the fingers. The user can grip the handle on opposing sides of the box with one hand adjacent to one corner of the box and his other hand adjacent to a diagonally opposite corner. The bottom is configured to avoid freezing to pavement with leakage of contained liquids. Portions of the bottom are deflected downwardly to define internal liquid-trapping recesses and corresponding outer projections separated by flow channels. A plurality of drainage apertures are provided and fluid discharge in the flow channels escapes through open channel ends at the side wall.

1 Claim, 3 Drawing Sheets

REFUSE RECYCLING BOX

FIELD OF THE INVENTION

The invention relates to plastic refuse recycling boxes and more specifically to alleviating back strain which municipal workers experience in repeatedly lifting such boxes.

BACKGROUND OF THE INVENTION

Many municipalities have launched campaigns to recycle refuse. It is now common to see "blue boxes" which glass and metal containers are deposited for recycling. Although the containers are relatively compact, they can often be heavy in view of the depositing of bottles and the like. The new campaigns to recycle such refuse has been accompanied by numerous complaints from workers regarding backache. This has resulted in claims for compensation for back pains and reduction of productive work time.

The back strain problem is believed by the inventor to derive largely from the configuration and location of the box handles which make lifting very awkward. The boxes are customary left on pavement and a worker must stoop to raise the boxes. Tipping torques arise owing to uneven distribution of weight in the box which are borne by the worker's back. Additionally, these boxes have a bottom construction intended permit limited discharge of liquids from received containers. Many have a bottom construction in which the interior is formed with upwardly deflected rectangular portions. These are separated in the interior of the box by narrow channels which are intended to receive a limited amount of liquid and are formed with drainage apertures to discharge excess liquid. The arrangement represents a compromise: it is undesirable to subject a householder to leakage when the box is indoors, but a worker should not be subjected to the weight of an undue accumulation of liquids. The construction tends to trap discharged liquids beneath the box, which in colder regions results in freezing of the box to pavement. Back strain occurs when a worker attempts to lift the box and the box sticks to the pavement.

SUMMARY OF THE INVENTION

In one aspect, the invention provides a unitary injection-molded plastic refuse box adapted to reduced back strain during lifting of refuse contained in the box. The box comprises a bottom and a generally rectangular side wall which together define a compartment for storing refuse. The side wall has a first pair of opposing sides, a second pair of opposing sides generally perpendicular to the first pair, and an upper side wall portion which defines an opening for receiving the refuse. A pair of handle portions are formed with the upper side wall portion external to the compartment. In preferred form, the handle portions are integral parts of one continuous handle extending circumferentially about the side wall. Each handle portion has a substantially uniform inverted L-shaped cross-section transverse to the associated side, the cross-sectional dimensions being sufficiently large that a person can insert his fingers between the handle portion and the associated side wall at least to the second segment of his fingers. Each handle portion extends along substantially the full horizontal width of the associated side such that the user can grip one of the handle portions with one hand adjacent to one corner of the box and can simultaneously grip the other handle portion with his other hand adjacent to a diagonally opposite corner of the box.

Certain aspects of this recycling box should be noted. First, most worker tend to approach a refuse box with one leg forward, bending over the forward leg to grasp and raise the box. In such an approach, the hands tend naturally to be positioned adjacent diagonally opposite corners of the box, and the box handle portions accommodate this natural positioning. When lifting the box with hands adjacent diagonally opposite corners, the centre of gravity of the contained refuse will tend be located somewhere between the worker's hands regardless of the distribution of the weight of the refuse. Proper gripping of the handles owing to their cross-sectional dimensions also permits the worker's hands and wrist to accommodate tipping torques. The results is that the worker's back is not required to accommodate unbalanced torques arising from any significantly uneven distribution of weight.

The bottom of the refuse box perferably comprises an inner surface and an outer surface, a plurality of deflected portions, and a connecting portion surrounding the deflected portions and joining the deflected portions to one another and to the side wall. The deflected portions are deflected downwardly relative to the connecting portions to define in the inner surface a plurality of liquid-trapping recesses and to define in the outer surface a plurality of projections corresponding to the recesses. They also define a plurality of flow channels separating the projections and having open ends at the side wall. A plurality of drainage apertures are formed in the connecting portions thereby permitting a predetermined quantity of liquid to accumulate in the recesses before discharge occurs. However, the excess drained from the compartment is not confined beneath the box by its side wall but escapes freely through the open ends of the drainage passages. Accordingly, limited trapping of liquids is provided, but the tendency of the box to freeze to pavement or the like in response to discharge of excess liquids is avoided.

Various aspects of the invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENT

Figure 1:
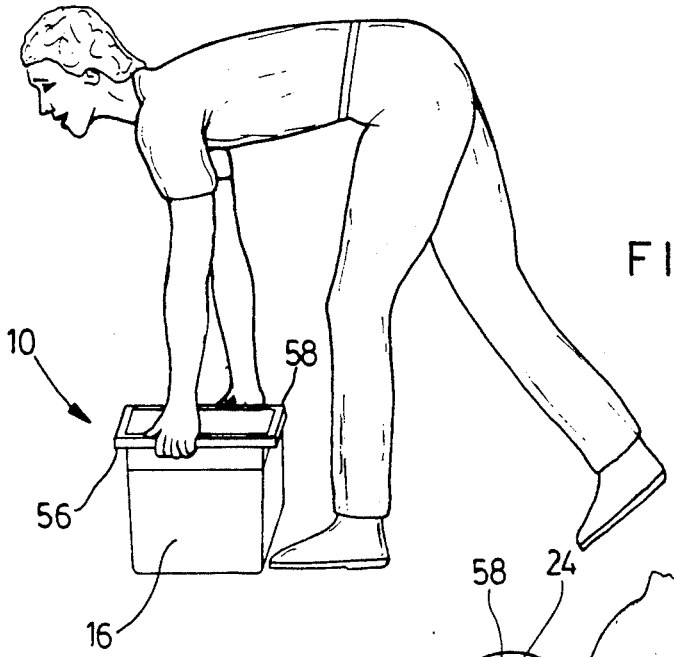
FIG. 1 is a perspective view of a plastic recycling box filled with refuse and being lifted by a worker.
Figure 2:
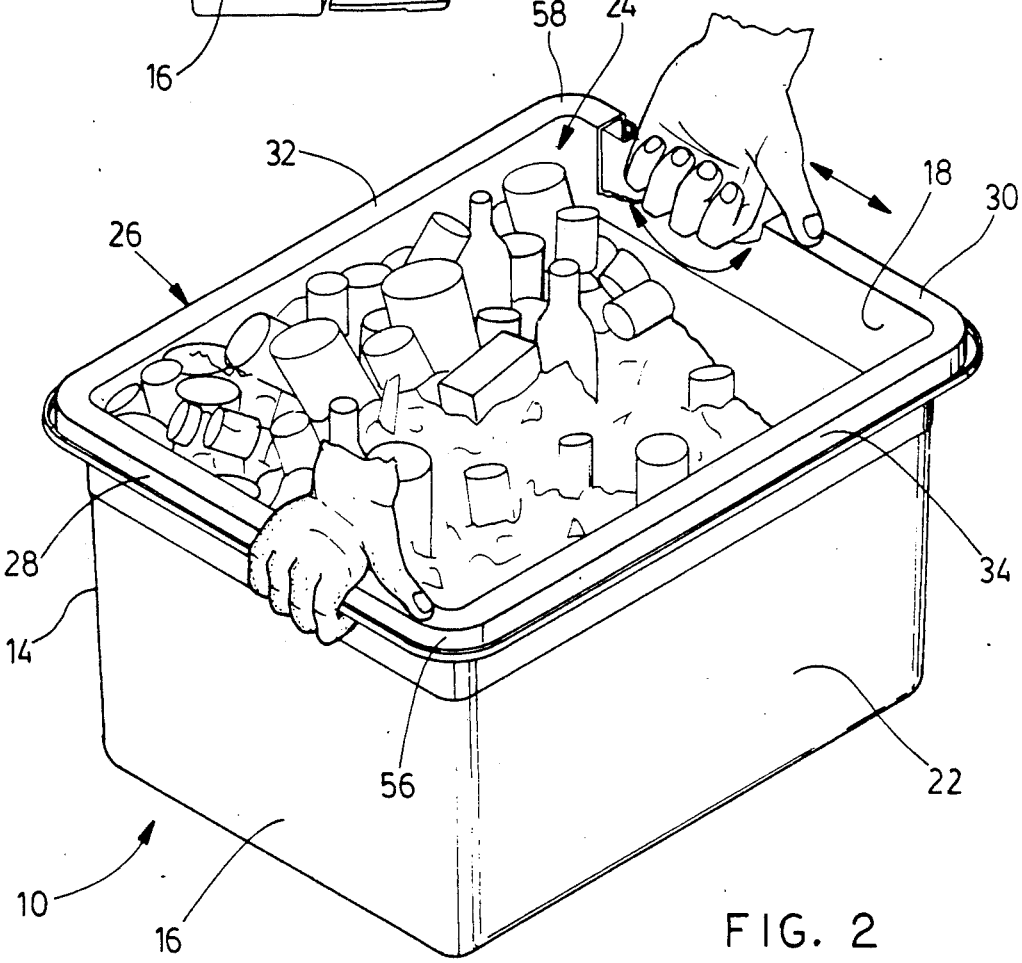
FIG. 2 is a fragmented perspective view showing in greater detail how a circumferential handle associated with the box is gripped.
Figure 3:
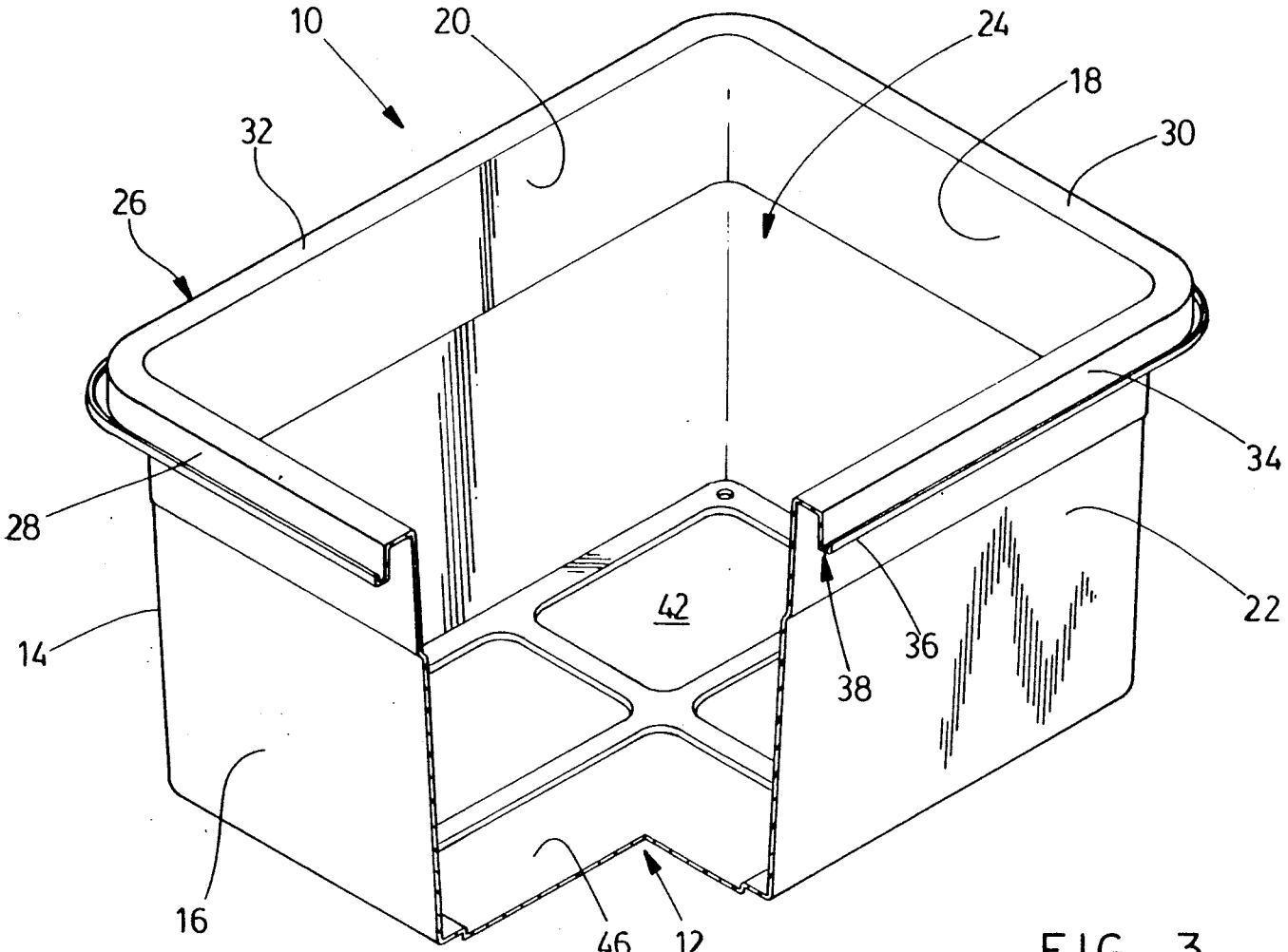
FIG. 3 is a fragmented perspective view showing the bottom contruction of the box from within.
Figure 4:
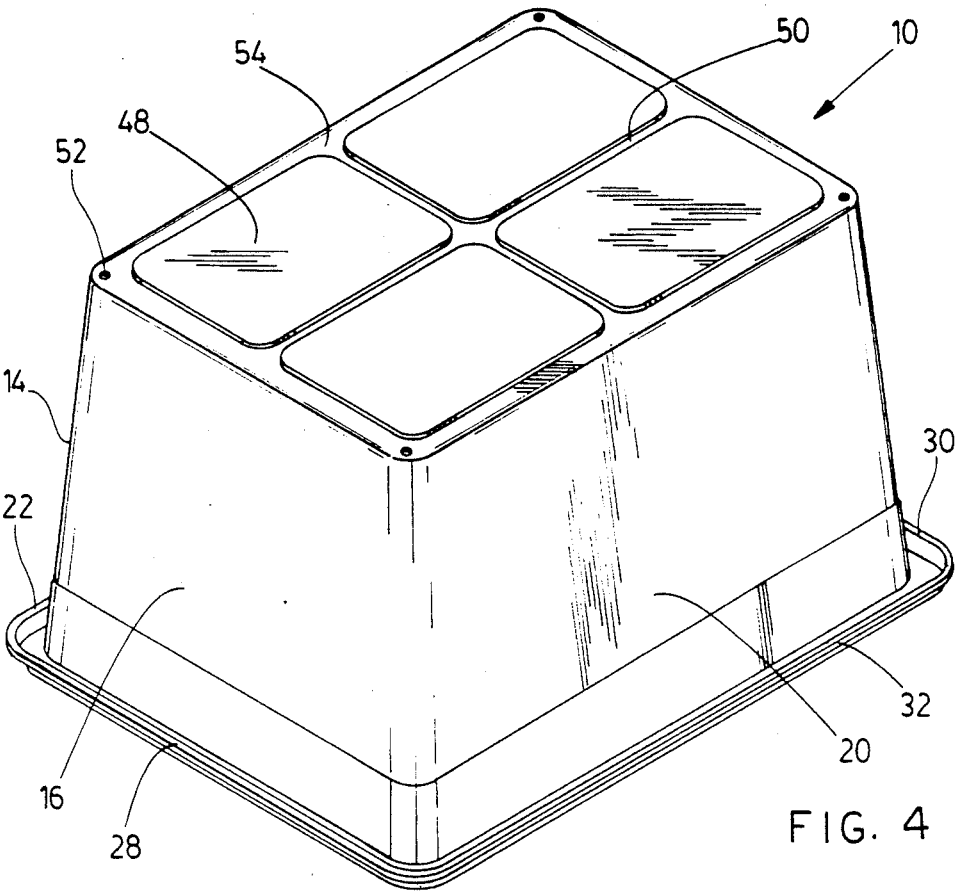
FIG. 4 is a perspective view of the box inverted illustrating the bottom configuration of the box from the exterior; and, FIG. 5 is a fragmented cross-sectional view of a handle illustrating the L-shaped cross-section dimensioning relative to a worker's hand.

Reference is made to FIGS. 1–4 which illustrates the overall configuration of a unitary injection-molded plastic refuse box 10. The box 10 has a bottom 12 and a generally rectangular sidewall 14 which together define a compartment for storing refuse. The sidewall 14 comprises a first pair of opposing sides 16, 18 and a second pair of opposing sides 20, 22 oriented transverse the first pair. An upper sidewall 14 portion defines an opening 24 surrounded by the various sides for receipt of the refuse. The unitary injection-molded construction makes the cost of production of the box appropriate for wide-scale use.

Figure 5:
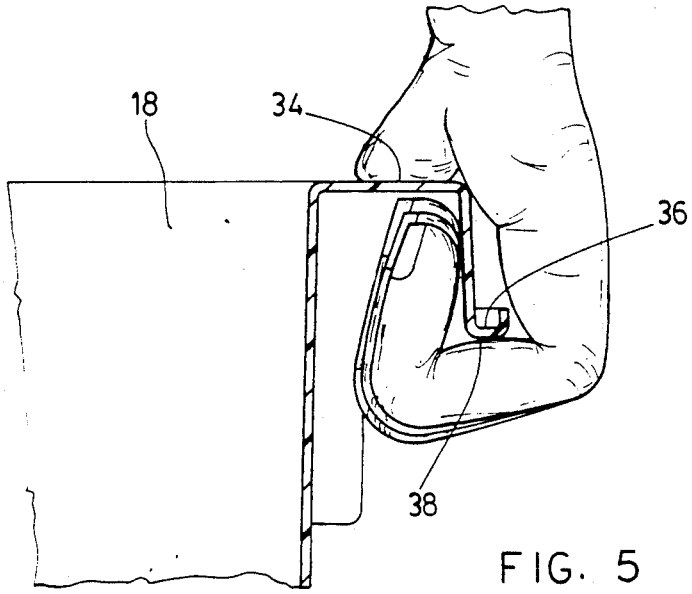

A handle 26 extends circumferentially about the upper sidewall 14 portion external to the compartment. The handle 26 has a substantially uniform inverted L-shaped cross-section transverse to the sidewall 14. This cross-section is apparent in FIGS. 3 and 5. The cross-sectional dimensions of the handle 26 are sufficiently large that a person of average size can insert his fingers between the handle 26 and the associated sidewall 14 to the second joint of his fingers, substantially as illustrated in FIG. 5. The handle 26 effectively comprises a pair of handle portions 28, 30 associated with the first pair of sides 16, 18 and a second pair of handle portions 32, 34 associated with the second pair of sides 20, 22. This arrangement permits lifting of the box 10 at either pair of sides (although most lifting will likely be done at the short sides 16, 18).

The handle 26 includes a lowermost terminating portion 36 extending circumferentially about the sidewall 14 in spaced-apart and parallel relationship with the sidewall 14. The terminating portions define a downwardly-facing surface 38 having a substantially uniform generally convex cross-section transverse to the sidewall 14. The terminating portion 36 is defined by molding an upwardly-opening U-shaped structure with lower portions of the handle 26. The forming of the terminating portion 36 outwardly of the handle 26 facilitates molding and also imparts greater rigidity to the handle 26. Plastic reinforcing webs may be molded between the upper sidewall 14 portion and handle 26 to impart further rigidity, such as the web 40 apparent in FIG. 5. It is desirable, however, that such webs be thin and unobtrusive to permit gripping at various points along the circumference of the handle 26. The horizontal extent of the surface 38 transverse to the sidewall 14 is preferably greater than about three-eights of an inch. In use, the terminating portion 36 rests against the third finger segment (as viewed from tips of the fingers) of each finger to provide comfortable gripping of the box 10.

The bottom 12 is constructed to permit limited liquid retention yet avoid freezing to pavement in response to discharge of liquids. The bottom 12 may be seen to comprise an inner surface 42 and an opposing outer surface 44 whose features are most apparent in FIGS. 3 and 4. Four generally rectangular portions of the bottom 12 are deflected downwardly to define in the inner surface 42 a plurality of liquid-trapping recesses, such as the exemplary recess 46 specifically indicated in FIG. 3. These portions also define in the outer surface 44 corresponding projections, projections conforming in shape and immediately overlaid by the recesses, such as the exemplary projection 48 specifically indicated in FIG. 4. This construction also defines a plurality 50 of flow channels in the outer surface 44, separating the projections and open at the sidewall 14. Drainage openings (only one such opening 52 specifically indicated in FIG. 4) are formed in a connecting portion 54 which surrounds the deflected portions and which joins the deflected portions to one another and to the sidewall 14. The drainage openings are above the level of the recesses and accordingly a limited amount of liquid, corresponding to the volume of the four recesses, can be stored before liquid is discharged.

The advantages of the recycling box with regard to reduction of back strain are best understood by considering conventional recycling boxes. Following commonly accepted prior practice, recycling boxes are formed with short handles centered at opposing box sides. The handles are also narrow such that a worker can barely insert his fingers under the handles and may be obliged to hold the handles with the tips of his fingers. The prior art boxes are adequate if weight is evenly distributed, that is, if the centre of gravity of the contained refuse is substantially centered within the box. Otherwise, a tipping torque exists (either toward or away from the worker) which cannot be readily reacted along the worker's arms. Also, the handles do not permit sufficient gripping to accommodate the unbalanced torques with the worker's hands and wrists which could in any event only accommodate a limited unbalanced torque. These unbalanced tipping torques appear to be accommodated by the worker's back thereby giving rise to complaints of back strain.

The position and extent of the handle portions 28, 30 together with the described cross-sectional construction obviate the need for a worker's back to accommodate otherwise unbalanced tipping torques. This will be apparent from FIG. 1 where a worker is shown initially raising the box 10 and also from FIG. 2. He approaches the box with one leg forward, bending over the forward leg with his hands locating naturally at diagonally opposite corners of the box. The hand associated with the forward leg tends to locate at a relatively distant corner 56 of the box; the hand associated with the rearward leg tends to locate at a diagonally opposite corner 58 proximate to the worker. The centre of gravity of the refuse contained in the box 10 might be located rearwardly of a left-to-right centre line of the box (parallel to and mid-way between the second pair of sides 20, 22), that is, towards the worker. This permits any uneven distribution of the weight of the refuse to be reacted more directly along the worker's arms, which is most critical during initial raising of the box 10. The construction of the handle portions 28, 30, permitting fingers to be inserted at least to second finger joints and consequently proper gripping, allows the wrists of the hands to accommodate some of the tipping torque arising with uneven weight distribution, the application of a counterbalancing torques by hand being indicated with curved line and arrows in FIG. 2. Since the handle portions 28, 30 span the entire width of the box, the worker can also shift his hands, as indicated by the straight line with arrows in FIG. 2, if the box proves very heavy, to distribute weight more evenly between them.

The box construction also reduces the tendency of the box 10 to stick to pavement in cold weather upon discharge of excessive contained liquids. In the prior art, as discussed above, the bottom is flat except for projections deflected upwardly to the interior of the box. Such construction is implicitly characterized by a circumferential shoulder at the junction of the box sidewall and box bottom, which shoulder rests against the pavement. The drainage openings are formed in the upward projections and lead into recesses formed in the outer surface of the bottom. The liquid which drains into the recesses tends to be trapped by the subjacent pavement and the circumferential shoulder. When a householder has discarded open container with substantial quantities of liquid, such prior art boxes tend to stick to the pavement as the trapped liquids freeze, particularly if the freezing extends back through the drainage recesses into the box itself. Unless a worker is particularly careful, he will attempt to lift such a prior art box from the pavement and experience a back-wrenching action as the box resists sudden lifting. The bottom construction of the present box 10 largely eliminates such problems by permitting free flow of liquids from the open-ended channels 50 to points outwardly of the sidewall 14.

It will be appreciated that a particular embodiment of the invention has been described and modifications may be made therein without departing from the spirit of the invention or the scope of the appended claims.

I claim:

1. A unitary injection-molded plastic refuse collection box permitting reduction of back strain during lifting of refuse contained in the box and permitting limited accumulation of liquid within the box and discharge of excess liquid from beneath the box without freezing of the box in cold weather to pavement on which the box is rested, comprising:

a bottom;

a generally rectangular sidewall comprising a first pair of opposing sides, a second pair of opposing sides generally perpendicular to the first pair of sides, and an upper sidewall portion defining a opening for receiving the refuse and surrounded by the first and second pairs of sides, the sidewall defining with the bottom a compartment for storing the received refuse;

a pair of handle portions formed with the upper sidewall portion external to the compartment, each of the pair of handle portions extending from and being associated with a different one of the first pair of opposite sides, each handle portion having a substantially uniform inverted L-shape cross-section transverse to the associated side, the cross-sectional dimensions of each handle portion being sufficiently large that a person can insert his fingers between the handle portion and the associated sidewall to the second segment of his fingers, each of the handles extending along substantially the full horizontal width of the associated side such that the user can insert his fingers between the handles and the first pair of sides at positions along the first pair of sides corresponding to any location within the compartment of the centre of gravity of the contained refuse, thereby reducing back strain during lifting;

the bottom comprising an inner surface, an outer surface, a plurality of deflected portions, and a connecting portion surrounding the deflected portions and joining the deflected portions to one another and to the sidewall, the deflected portions being deflected downwardly relative to the connecting portion to define in the inner surface a plurality of liquid-trapping recesses and to define in the outer surface a plurality of projections corresponding to the recesses and a plurality of flow channels separating the projections and open at the sidewall for escape of liquids beyond the sidewall, the bottom comprising a plurality of drainage apertures formed in the connecting portion thereby permitting excess liquid overflowing from the recesses to escape into the flow channels beneath the bottom and outwardly through the channels away from the box to avoid freezing of the box to the pavement.

* * * * *